US005110126A

United States Patent [19]

Kuebler

[11] Patent Number: 5,110,126

[45] Date of Patent: May 5, 1992

[54] TENNIS RACKET

[75] Inventor: Siegfried Kuebler, Ueberlingen, Fed. Rep. of Germany

[73] Assignee: Head Sportgeraete Gesellschaft m.b.H. & Co. OHG., Austria

[21] Appl. No.: 722,381

[22] Filed: Jun. 26, 1991

Related U.S. Application Data

[63] Continuation of Ser. No. 496,058, Mar. 16, 1990, abandoned, which is a continuation of Ser. No. 143,940, Jan. 14, 1988, abandoned.

[30] Foreign Application Priority Data

Jan. 15, 1987 [DE] Fed. Rep. of Germany ..... 3701022
Jan. 26, 1987 [DE] Fed. Rep. of Germany ..... 3702197

[51] Int. Cl.[5] ..... A63B 49/04
[52] U.S. Cl. ..... 273/73 R; 273/73 C
[58] Field of Search ..... 273/73 R, 73 C, 73 F, 273/73 G, 73 H, 73 J

[56] References Cited

U.S. PATENT DOCUMENTS

| | | | |
|---|---|---|---|
| Re. 31,419 | 10/1983 | Frolow | 273/73 C |
| 3,801,099 | 4/1974 | Lair | 273/73 D X |
| 3,913,911 | 10/1975 | Peterson | 273/73 C |
| 3,975,017 | 8/1976 | Golich | 273/73 C |
| 3,999,756 | 12/1976 | Head | 273/73 C |
| 4,153,249 | 5/1979 | Plagenhoef | 273/73 C |
| 4,192,505 | 3/1980 | Tabickman et al. | 273/73 C |
| 4,196,901 | 4/1980 | Durbin | 273/73 G |
| 4,291,574 | 9/1981 | Frolow | 273/73 C X |
| 4,690,405 | 9/1987 | Frolow | 273/73 C |
| 4,720,105 | 1/1988 | Ferrari et al. | 273/73 C |

*Primary Examiner*—William H. Grieb
*Assistant Examiner*—William E. Stoll
*Attorney, Agent, or Firm*—Finnegan, Henderson, Farabow, Garrett & Dunner

[57] ABSTRACT

A tennis racket having a racket head formed from a rod for serving as a tensioning frame, a string arrangement located within a plane in the racket head, an open frog zone adjoining the racket head and being laterally delimited on both sides by the rod, and a handle connected to the rod. The handle has a handle end and the racket head includes an apex at an end furthest from the handle end. The center of oscillation is located 470–500 mm from the handle end. A first weight is disposed on or within the handle at a distance of from 0–100 mm from the handle end. Second and third weights of equivalent mass are disposed on or within the racket head, the second and third weights being located on each side of an axis passing longitudinally through the racket and being disposed at an axial distance of 0–100 mm from a line extending through the apex in a direction perpendicular to the longitudinal axis of the racket. The total amount of the first, second, and third weights is in the range of 50–150 grams.

4 Claims, 1 Drawing Sheet

TENNIS RACKET

This application is a continuation of application Ser. No. 496,058, filed Mar. 16, 1990, now abandoned, which is a continuation of application Ser. No. 143,940 filed Jan. 14, 1988, now abandoned.

BACKGROUND OF THE INVENTION

1. Field of the Invention

The invention refers to a tennis racket comprising a string arrangement located within a plane and arranged in a racket head formed of a sectional rod and serving as a tensioning frame, an open frog zone adjoining the racket head and being laterally delimited at both sides by the sectional rod, and a handle—in the longitudinal axis of the racket. In particular, the present invention relates to a racket having a weight of 320 to 410 grams, a length of 650 to 720 mm and a balance point being located at a distance of approximately 310 to 335 mm from the handle end or the handle front, respectively.

2. Description of the Prior Art

The weight of such a stringed tennis racket is actually in the range between 325 and 400 grams and its length is between 66 and 71 cm. The stringed area has a length of 250 to 380 mm in the direction of the longitudinal axis of the racket and a maximum width of 180 to 280 mm. This data refers to typical rackets for adults. Rackets for young people and children have dimensions for the length of the racket and for the balance point deviating to lower values and also a differing weight.

SUMMARY OF THE INVENTION

In view of these facts, the inventor has undertaken the task of providing a tennis racket of the initially mentioned type—in particular a racket comprising a so-called open frog zone and a transverse rod delimiting this zone in direction to the stringing—and showing the already described parameters but showing better beating properties as compared with the prior art. It is, in particular, intended to substantially reduce a rebound moment acting on the hand of the player and to simultaneously increase the slam force.

This task is solved by a handle weight provided on or within the handle at a distance of approximately 0 to 100 mm, in particular 0 to 50 mm, from the handle front and by an additional weight or head weight uniformely distributed relative to the longitudinal axis of the racket on the free end of the racket head, the total amount of these weights being between 50 and 150 g. These weights may, according to the invention, be separate weights arranged on the racket or mass accumulations within the racket material at the locations defined according to the invention. This so-called mass accumulation exceeds, for example in a punctual manner, the usual weight of the racket uniformely distributed over the racket.

According to the invention, the additional weight or head weight shall be subdivided and be arranged at both sides of the longitudinal axis of the racket, which is preferably also the axis of symmetry, at an axial distance of 0 to 100 mm relative to a line extending through the zenith or apex in normal relation to the longitudinal axis of the racket.

According to a further feature of the invention, the additional head weights are given the shape of spheres, plates or rods and are arranged within the sectional rod whereas the handle weight, also having the shape of a sphere, a plate or a rod, is housed within a cavity of the handle in a stationary manner.

The ratio of the distance of the balance point from the handle end to the distance of the center of oscillation from the handle end is of particular importance; this ratio is, according to the invention equal or less than 0.71 or smaller.

It is also within the scope of the invention that the distance of the center of oscillation from the handle end is 470 to 500 mm corresponding to a period of 1.374 seconds to 1.417 seconds for a full oscillation of a racket freely oscillating around the handle end in case of an angle of impingement of less than 8°.

The invention shall be explained with reference to a numerical example. A commercially available racket corresponding to the prior art was compared with a tennis racket according to the invention. The data of both rackets were as follows a) a weight of 362 g in stringed condition;
b) a balance point at a distance of 32.5 cm from the handle end;
c) a total length of 68 cm;
d) exactly identical geometric dimensions and identical starting materials (graphite fibers embedded in epoxide resin);
e) a maximum length of the stringed area of 31.5 and cm;
f) a maximum width of the stringed area of 23.5 cm.

Generally, a usual so-called midsize racket is completely defined by this data. One datum also used when testing according to the respective technical literature (for example Tennis Magazine, 12th year of publication, book 1, January 87, p. 51) is the RA-value which gives information concerning the racket hardness. Both rackets showed the same value RA=82, which is evaluated in the graduation as extremely hard, because a RA-value of 100 corresponds to an infinite hardness and a value of 0 corresponds to an infinite softness.

The results of calculations as established by practical tests showed the following pattern:

In case of 874 ball contacts, the sum of all moments acting on the arm was, with a distribution of the balls impinging the stringed area having bell-shape, 8902 Nm for a racket according to the prior art. The greatest single moment was 28 Nm.

In case of a racket according to the invention, the corresponding values were 5236 Nm, i.e. lower for 41%, and the greatest observed single moment was 22 Nm (lower for 22%).

The slam force of the racket according to the invention was, however, 6.6% greater than that of the racket used for comparison purposes.

These impressive results were obtained on account of the fact that the mass distribution within the new racket has been varied such that, with the distance of the balance point from the handle end being maintained the same, the position of the center of oscillation is displaced in the direction toward the center of the impinging area. In the following, the distance of the handle end from the center of oscillation is designated by $r_S$ or named reduced pendulum length.

In the mentioned example, the mentioned distance $r_S$ (45 cm) according to the prior art was increased to 48 cm in the case of the racket according to the present invention.

It is common knowledge of the men skilled in the art that the slam force can be increased by arranging a greater mass in the head of the racket, and therefore it has already been proposed to produce rackets of lower weight and having their balance point located at 38.4 to 43.5 cm and having a reduced pendulum length $r_S$ of 49.9 cm. These rackets of low weight, which have an extreme nose heaviness and a proposed weight of 340 g are capable of developing the slam force of a racket having a weight of 397 g. Practice has shown that this proposal is not feasible; rackets of extreme nose heaviness are not accepted by the players, because the missing weight mass within the handle does not counteract the rebound moments occurring in case of impingement of a ball outside of the center of oscillation and represents an additional load for the system of links in the hand and in the arm.

In the U.S. Pat. No. 4,291,574, there are derived mathematical formulas for determining the reduced pendulum length on the basis of simple tests. Furthermore, reference is made to the stiffness of the frames and to its relation with the poor vibration properties of the rackets. Also in this case it is intended to develop a tennis racket of reduced weight and having a beat inertia corresponding to that of a heavy racket.

The inventive idea of the present invention strongly deviates from this object; the new racket proposed herein does not differ from a usual racket with respect to the weight, appearance or the location of the balance point. The center of vibration shall, however, be shifted—by the claimed features—into the geometric center of the stringed area by a suitable arrangement of masses within the racket head and the racket handle. In this case, the polar moment of inertia around the axis coinciding with the longitudinal axis of the handle shall still be increased. Simultaneously, the accumulation of weight on the handle shall be placed as far as possible at its outermost end because the greatest effect results at this location, and this for the purpose to be in the position to counteract reactive moments within the handle appearing as mass inertia and stressing the system of joints in the hand and in the arm.

In midsize rackets, the subjective geometric center is arranged at approximately 50 cm, whereas this center is arranged at 48.5 cm in largehead rackets having a beating area increased for 50% and at 52 cm in normal rackets.

The geometry of the largehead rackets assists the requirement to allow shifting the $r_S$ into the subjective geometric center. In this connection, it should be noted that oval rackets having a pointed eggshape in the direction of the apex or zenith have an influence on the geometry inasfar as the subjective geometric center is shifted to the center of vibration. This, however, does also not result in the desired effect because the beat inertia can thereby not be improved.

BRIEF DESCRIPTION OF THE DRAWING

Further advantages, features and details of the invention result from the following description of a preferred embodiment as well as from the drawing, in which.

DETAILED DESCRIPTION OF THE DRAWING

Figure 2:
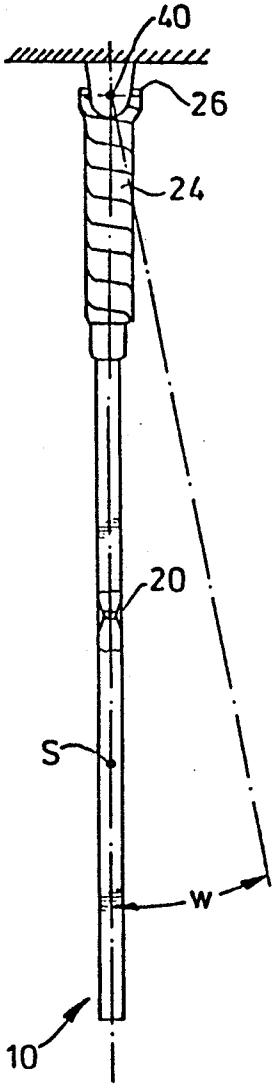
FIG. 1 is the top plan view of a tennis racket and FIG. 2 is an illustrating draft for FIG. 1.

A tennis racket 10 having a total length e of 680 mm has as the racket head 12 an oval tensioning frame formed of a correspondingly bent sectional rod 13 and consisting of graphite fibers embedded in epoxyde resin. This sectional rod 13 passes over at both sides of the longitudinal axis M of the racket via respective shoulder sections 14 into a profile arm 16. The profile arms 16 laterally delimit an open frog zone 18 being delimited by a transverse web 20. A neck or shaft 22 adjoins the frog zone 18 and is extended by a handle 24, having a handle front 26, said handle being enveloped by wrapped leather.

The racket head 12 and the transverse web 20 surround a stringed area Q comprising transverse strings 28 and longitudinal strings 29 crossing the transverse strings. The greatest length h of the stringed area Q is 315 mm, whereas its greatest width b is 235 mm. The weight of the stringed tennis racket 10 is 362 g.

A handle weight 30 is arranged at a distance i of approximately 0 to 100 mm from the handle front 26, while a head weight 32 is arranged within the sectional rod 13 at each side of the longitudinal axis or axis of symmetry M of the racket. These head weights 32 are located on a straight line N crossing the longitudinal axis M of the racket and extending at a distance a of approximately 0 to 100 mm from the zenith or apex 34 of the racket head 12. The weights 32 are preferably ball-shaped and stationarily mounted within the sectional rod 13.

A balance point B of the tennis racket 10 is located at a distance $r_B$ of 310 to 334 mm from the handle front 26, while a vibration point S is, in this case, located at a distance $r_S$ of 470 to 500 mm from the handle front 26.

In FIG. 2, the tennis racket 10 is connected at 40 with the end of its handle 26 connected for free pendulum movement with an angle of deflection w of less than 8°. With a distance $r_S$ of 470 to 500 mm of the center of vibration S from the handle front 26, the period of oscillation for a complete oscillation is, in this case, between 1.374 seconds and 1.417 seconds.

For a rod of uniformely distributed mass (irrespective of the order of magnitude), the location of the balance point B is for a length e half of this length e as measured from the end of the rod. If the end is considered as the zero point of the pendulum, the location of the center of oscillation S or the reduced pendulum length is $$r_S = \frac{e}{1.5} = \frac{r_B}{0.75}.$$

For a usual racket length e of 680 mm, $r_S$ becomes 450 mm. Based on measurements made on usual rackets, the value $r_S$ is 435 to 465 mm as referred to a racket length e of 680 mm. It can be therefore be concluded that usual tennis rackets have a rather uniform mass distribution and that small additional weights have only a small influence when calibrating the racket.

For the purpose of showing what magnitude of weight is required for substantially increasing $r_S$ another rod shall be tested which has a length of 680 mm and a uniformely distributed mass. On each of its ends there is fixed 1/6 of its mass: weight of the rod, for example, 240 g, 60 g at each end, makes a total weight of 360 g (approximately the weight of a normal tennis racket).

By tests, the value for $r_S$ is determined with 515 mm. In the tennis racket 10 according to the invention, a space of 0 to 100 mm is required for mounting the handle weight 30 at the end of the handle 24. Because the polar moment of inertia around the longitudinal axis M of the racket shall be assisted, the weight on the racket head 12 must be subdivided and both parts must be arranged at both sides of this longitudinal axis M of the racket at a distance of approximately 60 mm from the head end or apex or zenith 34.

If the above mentioned additional weight of 120 g—now subdivided into handle weight 30 (60 g) and the head weights 32 (30 g each) is maintained, $r_S$ becomes 490 mm.

In a preferred embodiment, the handle weight has 48 g, each head weight has 29 g and $r_S$ is 480 mm.

Figure 1:
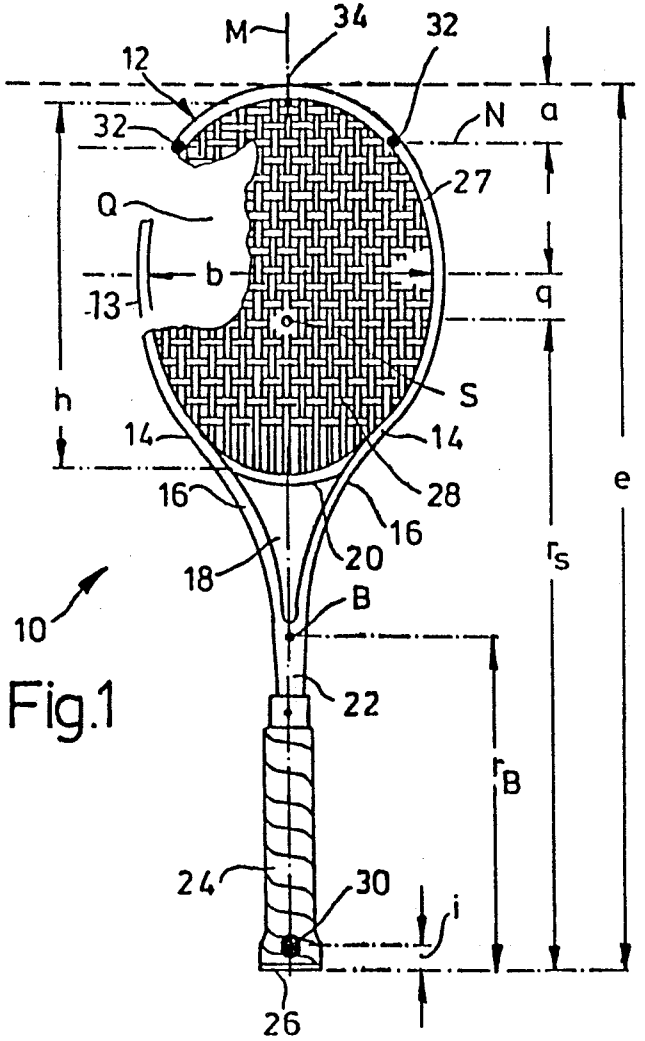

It was the pronounced object of the author of U.S. Pat. No. 4,291,574 to shift the center of vibration S into the geometric center of the beat area or stringed area Q, respectively. However, the latter deviates from the so-called subjective geometric center; if a player is asked to seek the geometric center, he will, as a rule, indicate a point which is displaced in direction to the transverse web 20 relative to the actual geometric center for 10 to 20 mm (length g in FIG. 1), which is an optical illusion caused by the geometry of the racket. This fact is stressed by the observation, that in case of a worn stringed area the subjective center, which most frequently can be recognized on account of a red tinge (sand of the tennis court), also is located 10 to 20 mm below the actual geometric center, i.e. at a lower distance than the latter.

According to the invention the center of oscillation S is not displaced to the geometric center, but somewhat into the mentioned subjective center. In the tennis racket 10 according to the invention, the subjective center is located at a distance of approximately 500 mm from the handle front 26; if the tennis racket 10 would have been construed with $r_S=500$ mm, the handle weight 30 would, in this case, have 72 g and each head weight 33 would have a weight of only 36 g. This would mean that with the materials and the construction methods presently at disposal, only a tennis racket could be produced which has too low a mechanical strength and stiffness.

For this theoretical tennis racket it can be, calculated which moments would have been generated on the handle 24 in case of assumed 874 ball contacts: 4 462 Nm, i.e. 50% less as in the case of a normal tennis racket. The greatest moment would be 18 Nm, i.e. 36% less than in case of a normal racket.

The mentioned examples were referred to so-called midsize rackets having a beat area which is approximately 30% greater than that of a normal racket.

The mass inertia moment of a racket around the handle end corresponds to the product $$m \cdot r_B \cdot r_S$$

If m and $r_B$ remain, as defined, unchanged, this moment is increased proportional to $r_S$, which is an object of this invention.

For the purpose of determining $r_S$, there is used the simplified mathematical formula for a physical pendulum of low deflection (reduced pendulum length $r_S=0.249T^2$ in meters, wherein T is the oscillating period for a complete oscillation.

What is claimed is:

1. A tennis racket having a weight of 320 to 410 grams, a length of 650 to 720 m and a balance point located 310 to 335 mm from the handle end, the racket comprising:

a racket head formed from a rod for serving as a tensioning frame;

a string arrangement located within a plane in the racket head;

an open frog zone adjoining the racket head and being laterally delimited on both sides by the rod;

a handle connected to the rod, said handle having a handle end, the racket center of oscillation being located 470–500 mm from the handle end, said racket head including an apex at an end furthest from the handle end;

a first weight disposed on or within said handle at a distance of from 0–100 mm from said handle end; and second and third weights of equivalent mass disposed on or within the racket head, said second and third weights being located on each side of an axis passing longitudinally through the racket and being disposed at an axial distance of 0–100 mm from a line extending through the apex in a direction perpendicular to the longitudinal axis of the racket;

wherein the total amount of said first, second and third weights is in the range of 50–150 grams; said first, second and third weights for reducing the rebound moment and increasing the slam force of the racket.

2. The tennis racket of claim 1, wherein the first weight is disposed at a distance of from 0–50 mm from the handle end.

3. The tennis racket of claim 1 or 2, wherein the handle includes a cavity and the first weight is disposed in said handle cavity.

4. The tennis racket of claim 1, wherein the ratio of the distance of the balance point from the handle end to the distance of the center of oscillation from the handle end is 0.71 or less.

* * * * *

UNITED STATES PATENT AND TRADEMARK OFFICE

CERTIFICATE OF CORRECTION

PATENT NO. : 5,110,126

DATED : May 5, 1992

INVENTOR(S) : Siegfried KUEBLER

It is certified that error appears in the above-identified patent and that said Letters Patent is hereby corrected as shown below:

Claim 1, column 6, line 12, change "m" to --mm--.

Signed and Sealed this

Sixth Day of July, 1993

Michael K. Kirk

*Attest:*

MICHAEL K. KIRK

*Attesting Officer*

*Acting Commissioner of Patents and Trademarks*